US009106041B2

(12) United States Patent
Lee

(10) Patent No.: US 9,106,041 B2
(45) Date of Patent: Aug. 11, 2015

(54) ELECTRICAL POWER CONNECTOR FABRICATION METHOD

(71) Applicant: RIIDEA International Corp., Apia (WS)

(72) Inventor: Lung-Hsi Lee, New Taipei (TW)

(73) Assignee: RIIDEA International Corp., Apia (WS)

( * ) Notice: Subject to any disclaimer, the term of this patent is extended or adjusted under 35 U.S.C. 154(b) by 439 days.

(21) Appl. No.: 13/720,058

(22) Filed: Dec. 19, 2012

(65) Prior Publication Data

US 2013/0199036 A1 Aug. 8, 2013

(30) Foreign Application Priority Data

Dec. 22, 2011 (TW) ..... 100147946 A

(51) Int. Cl.
*H01R 43/16* (2006.01)
*H01R 43/24* (2006.01)

(52) U.S. Cl.
CPC ..... *H01R 43/16* (2013.01); *H01R 43/24* (2013.01); *Y10T 29/4922* (2015.01); *Y10T 29/49174* (2015.01); *Y10T 29/49176* (2015.01); *Y10T 29/49222* (2015.01)

(58) Field of Classification Search
CPC ..... H01R 43/00; H01R 43/16; H01R 43/24; Y10T 29/49176; Y10T 29/49174; Y10T 29/49117; Y10T 29/49; Y10T 29/4922; Y10T 29/49222; Y10T 29/49204
USPC ..... 29/858, 857, 825, 592.1, 883, 882, 884, 29/874, 876, 877, 881, 885; 174/153 R
See application file for complete search history.

(56) References Cited

U.S. PATENT DOCUMENTS

| | | | | | |
|---|---|---|---|---|---|
| 3,914,009 | A * | 10/1975 | Chia et al. | 420/534 |
| 5,060,373 | A * | 10/1991 | Machura et al. | 29/858 |
| 5,722,861 | A * | 3/1998 | Wetter | 439/701 |
| 6,125,535 | A * | 10/2000 | Chiou et al. | 29/883 |
| 6,966,800 | B2 * | 11/2005 | Mott | 439/722 |
| 7,316,064 | B2 * | 1/2008 | Chou et al. | 29/884 |
| 7,503,112 | B2 * | 3/2009 | Ice et al. | 29/883 |
| 2010/0112848 | A1 * | 5/2010 | Early et al. | 439/441 |
| 2013/0111749 | A1 * | 5/2013 | Lee | 29/885 |
| 2013/0227839 | A1 * | 9/2013 | Lee | 29/858 |
| 2013/0227840 | A1 * | 9/2013 | Lee | 29/879 |
| 2013/0333211 | A1 * | 12/2013 | Lee | 29/877 |
| 2014/0030932 | A1 * | 1/2014 | Lee | 439/693 |
| 2014/0352145 | A1 * | 12/2014 | Lee | 29/876 |

* cited by examiner

*Primary Examiner* — Peter DungBa Vo
*Assistant Examiner* — Azm Parvez
(74) *Attorney, Agent, or Firm* — Muncy, Geissler, Olds & Lowe, P.C.

(57) ABSTRACT

An electrical power connector fabrication method includes employing a cold drawing technique by using a series of dies to repeatedly draw a metal round rod into a thin thickness conducting contact bar, processing one end of the thin thickness conducting contact bar into a mating contact portion, stamping a part of the thin thickness conducting contact to form a mounting portion, cutting off the thin thickness conducting contact bar to obtain a finished metal contact formed of the mounting portion and the mating contact portion, repeating the aforesaid steps to obtain a large amount of metal contacts, attaching individual metal contacts to respective locating notches of a contact material strip, using an injection molding technique to mold electrically insulative housings on the metal contacts to form a number of electrical power connectors at a time, and then removing the contact material strip from the metal contacts.

13 Claims, 19 Drawing Sheets

ELECTRICAL POWER CONNECTOR FABRICATION METHOD

This application claims the priority benefit of Taiwan patent application number 100147946, filed on Dec. 22, 2011.

BACKGROUND OF THE INVENTION

1. Field of the Invention

The present invention relates to electrical connector technology and more particularly, to an electrical power connector fabrication method, which employs a cold drawing procedure to draw a metal round rod into a conducting contact bar, and then stamping and cutting techniques to make metal contacts, and then an injection molding technique to mold electrical housings on metal contacts so that a large number of electrical power connectors can be formed rapidly at a time, saving the cost.

2. Description of the Related Art

Power sockets are widely used in electric and electronic devices, such as portable audio, audio and video players (CD, VCD, DVD players), computer, notebook computer, mobile phone and other information products for connection to a city power outlet for power input so that the electric and electronic devices can obtain the necessary working power supply and can be operated by a user.

A power socket has at least one metal contact that can be made in a solid or hollow form. A hollow metal contact, as shown in FIG. 18, is made by: using a stamping technique to stamp a metal sheet material, for example, copper sheet material into a predetermined shape, and then bending the shaped copper sheet material into a cylindrical configuration having a rounded contact portion A at its one end and a flat mounting portion B at its other end. Because this design of hollow metal contact is made by curving a shaped copper sheet material into a cylindrical configuration without riveting, the applied force must be properly controlled when curving the shaped copper sheet material. If the applied force is excessively high or insufficient, the two opposite side edges of the shaped copper sheet material may not be positively and accurately abutted against each other after formation of the metal contact, lowering the product yield rate. Further, a hollow metal contact has a relatively lower structural strength, and can easily be deformed or damaged upon connection between the power socket and a mating electrical connector. Further, when curving a shaped copper sheet material into a cylindrical configuration, a seam line will be left at the front side of the hollow metal contact, affecting the sense of beauty of the outer appearance of the hollow metal contact.

Further, a power socket using solid contacts is known, as shown in FIG. 19, comprising an electrically insulative housing C, and a first solid contact D and a second solid contact E mounted in the electrically insulative housing C. The first solid contact D has a locating flange D1 extending around the periphery thereof and positioned in a front side of a back wall of the electrically insulative housing C and a rear mounting end D2 extended out of the back wall of the electrically insulative housing C. The second solid contact E is riveted to the rear mounting end D2 of the first solid contact D. Further, the first solid contact D is made of a metal material using a milling technique. However, because the locating flange D1 has a relatively larger outer diameter than the first solid contact D, the metal material used for making the first solid contact pin D must have a diameter not less than the outer diameter of the locating flange D1. Thus, about 40% of the metal material is wasted, increasing the material cost. Moreover, further waste recycling is necessary to recycle waste metal material. Further, because the first solid contact D and the second solid contact E are riveted together, they may be loosened from each other after a long use. If the first solid contact D and the second solid contact E are loosened, a large electrical resistance may be produced during transmission of electricity, leading to the problems of high temperature, poor contact, electric shock or connector dropping and severely affecting application safety.

Therefore, the fabrication of electrical power connectors using either solid or hollow metal contacts according to the prior art methods has the drawbacks of low metal contact structural strength, low product yield rate, large amount of waste material, requirement of an extra waste material recycling treatment, and high manufacturing cost.

Therefore, it is desirable to provide a method for making metal contacts and electrical power connectors that eliminates the aforesaid problems.

SUMMARY OF THE INVENTION

The present invention has been accomplished under the circumstances in view. It is therefore the main object of the present invention to provide an electrical power connector fabrication method, which greatly improves electrical power connector fabrication efficiency, shortens electrical power connector fabrication time, increases electrical power connector yield rate, and reduces electrical power connector manufacturing cost.

To achieve this and other objects of the present invention, an electrical power connector fabrication method comprises the steps of: employing a cold drawing technique with the use of a series of dies having different diameters of drawing holes to repeatedly draw a metal round rod into a thin thickness conducting contact bar, and then processing one end of the thin thickness conducting contact bar into a mating contact portion, and then stamping a part of the thin thickness conducting contact to form a mounting portion, and then cutting off the thin thickness conducting contact bar so that a finished metal contact formed of the mounting portion and the mating contact portion is obtained, and then repeating the aforesaid steps to obtain a large amount of metal contacts, and then attaching individual metal contacts to respective locating notches of a contact material strip, and then using an injection molding technique to mold electrically insulative housings on the metal contacts to form a number of electrical power connectors at a time, and then removing the contact material strip from the metal contacts.

Further, an automatic or manual equipment can be used for quick positioning of metal contacts in the locating notches of the contact material strip. Further, the metal round rod can be selected from copper or copper alloys. Further, the mounting portion of each metal contact can be configured for one of wire bond, wire clamp and DIP (dual inline package) applications, and the mating contact portion of each metal contact can be configured to have a conical shape. Further, an electrical wire can be connected to the mounting portion of each metal contact before insertion into a molding mold for molding. Further, a shoulder is formed on each metal contact between the contact portion and the mounting portion during fabrication.

Further, one individual metal contact, two metal contacts, or three metal contacts can be inserted into each cavity of each molding mold for making a 2-pin or 3-pin electrical power connectors.

Further, the mounting portion of each metal contact can be made in a substantially I-shaped form, having one end thereof forming a shoulder and connected to the mating contact portion and an opposite end thereof forming a clamping tailpiece. Alternatively, the mounting portion can be made in a substantially T-shaped form, having one end thereof forming a shoulder and connected to the mating contact portion and an opposite end thereof forming a plug tip.

DETAILED DESCRIPTION OF THE PREFERRED EMBODIMENT

Figure 1:
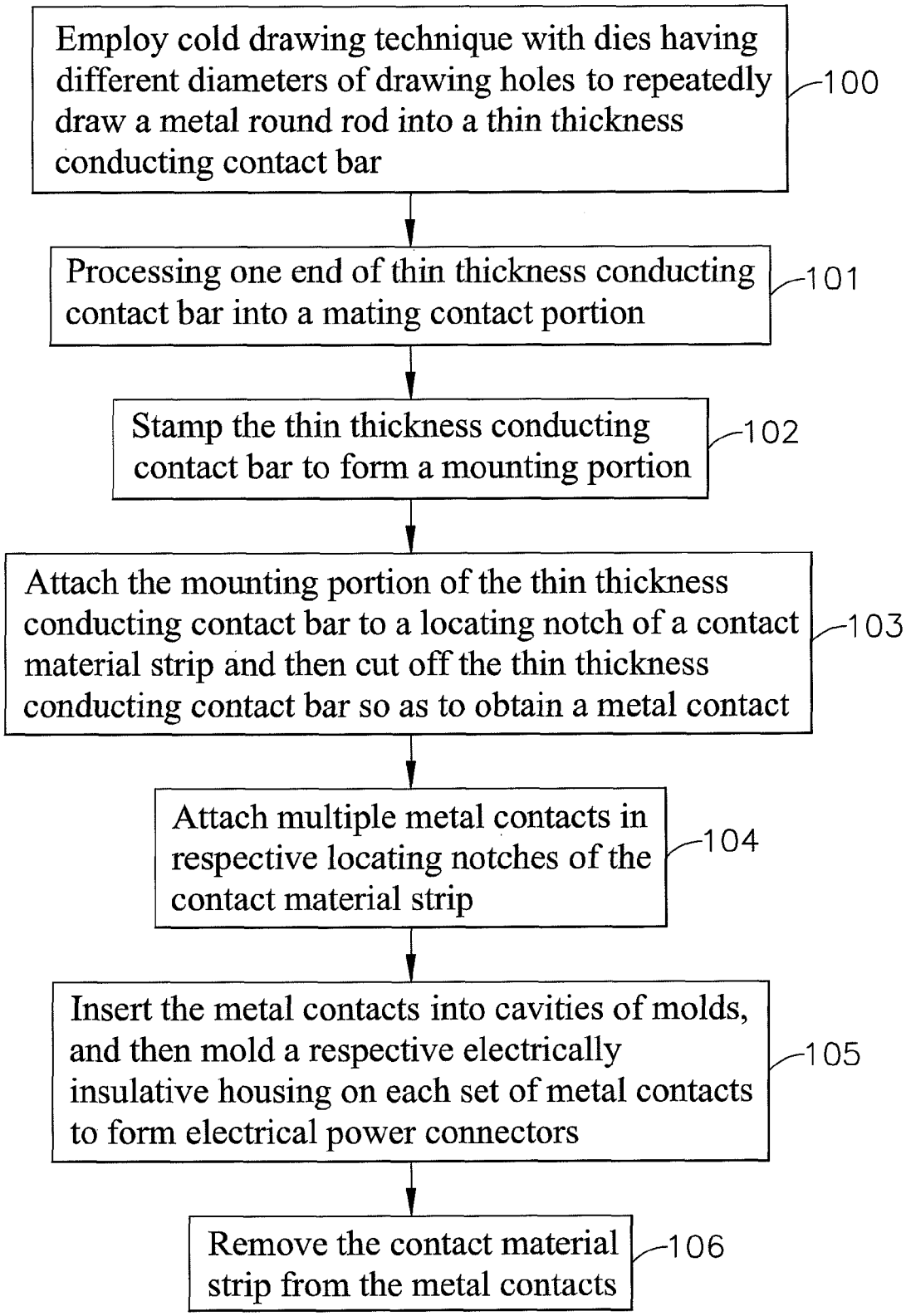
FIG. 1 is a flow chart of an electrical power connector fabrication method in accordance with a first embodiment of the present invention.
Figure 2:
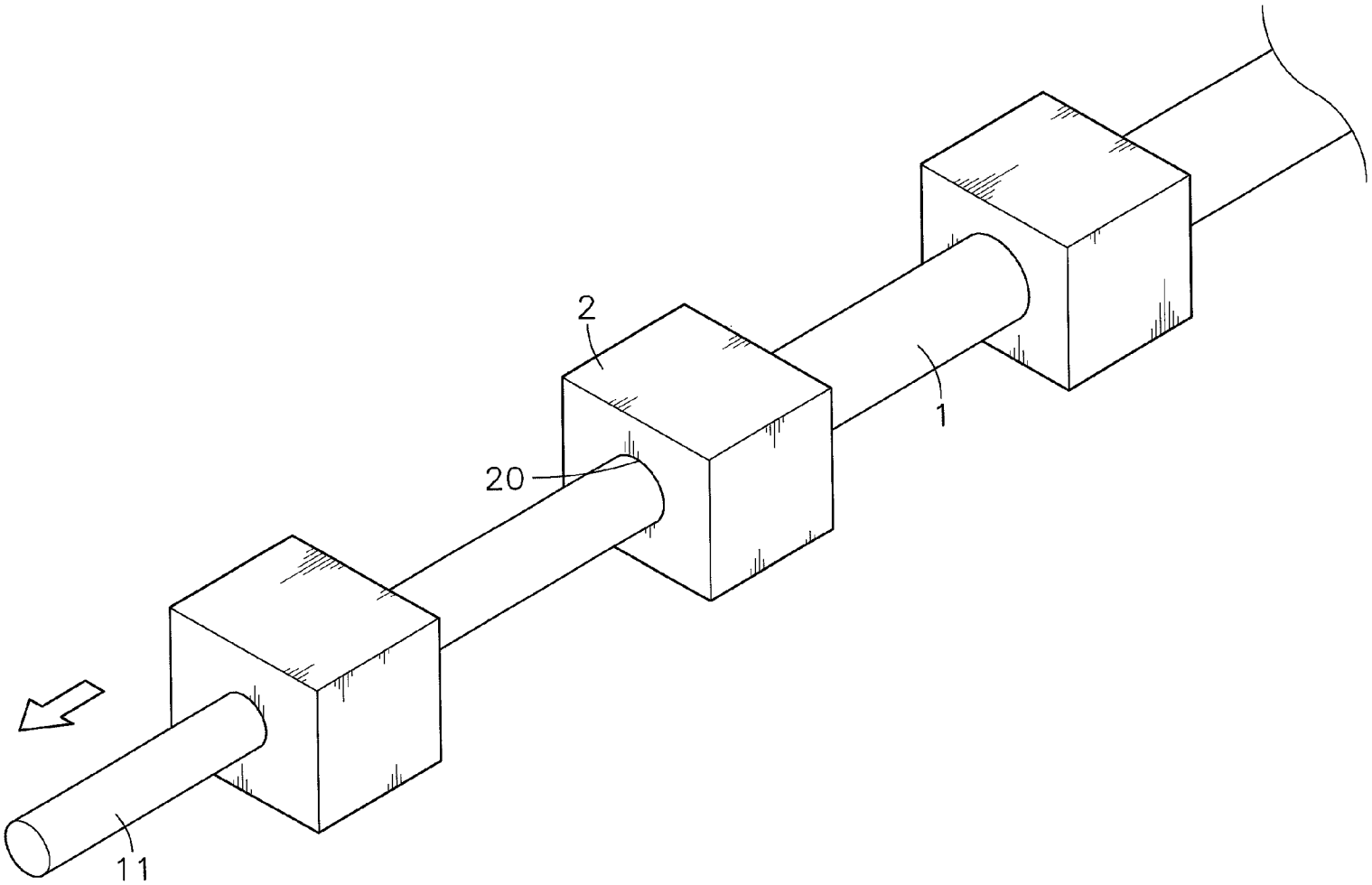
FIG. 2 is a schematic drawing illustrating the performance of a cold drawing step of the electrical power connector fabrication method in accordance with the first embodiment of the present invention.
Figure 3:
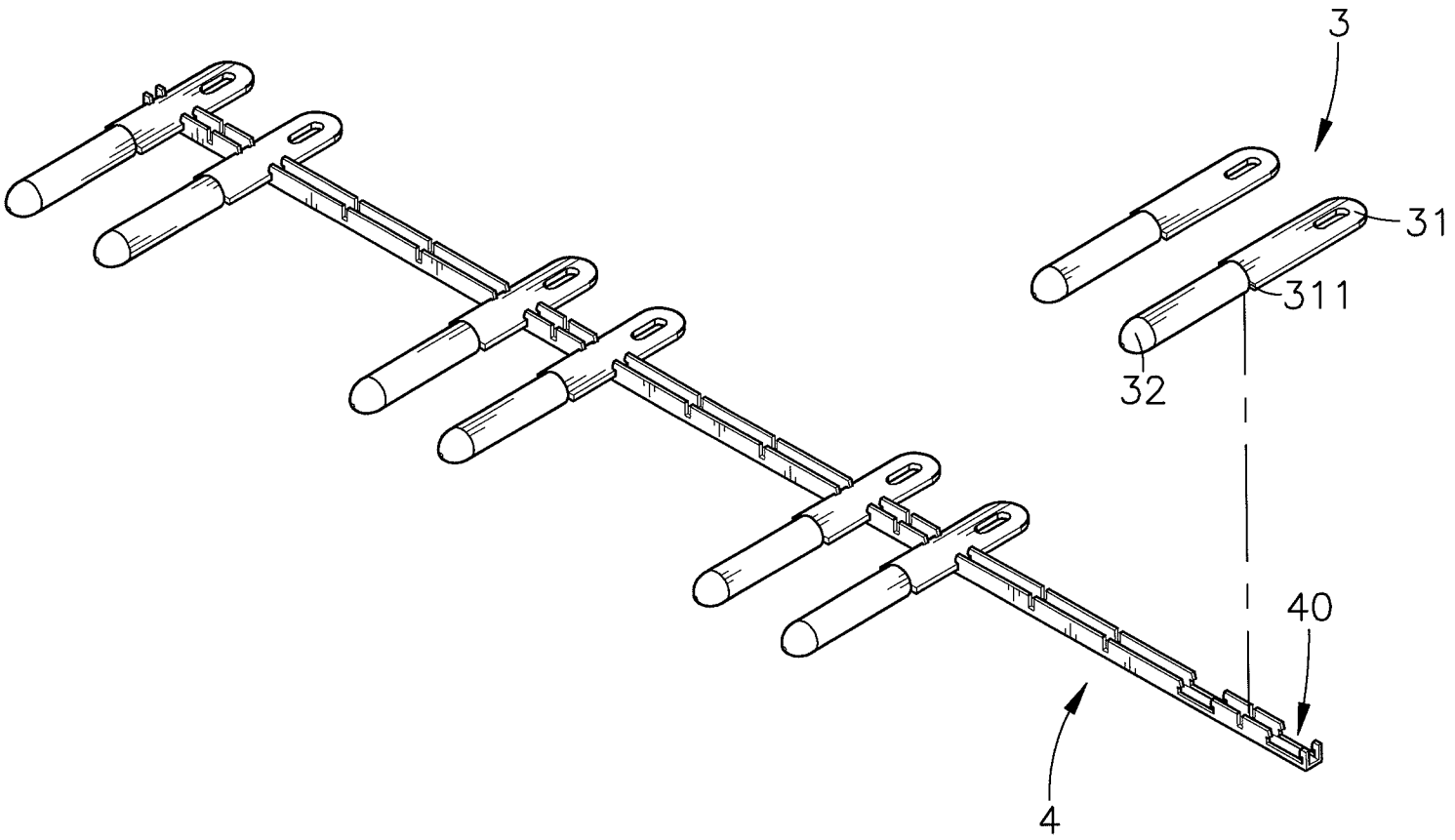
FIG. 3 is a schematic drawing illustrating installation of metal contacts in a contact material strip during the application of the electrical power connector fabrication method in accordance with the first embodiment of the present invention.
Figure 4:
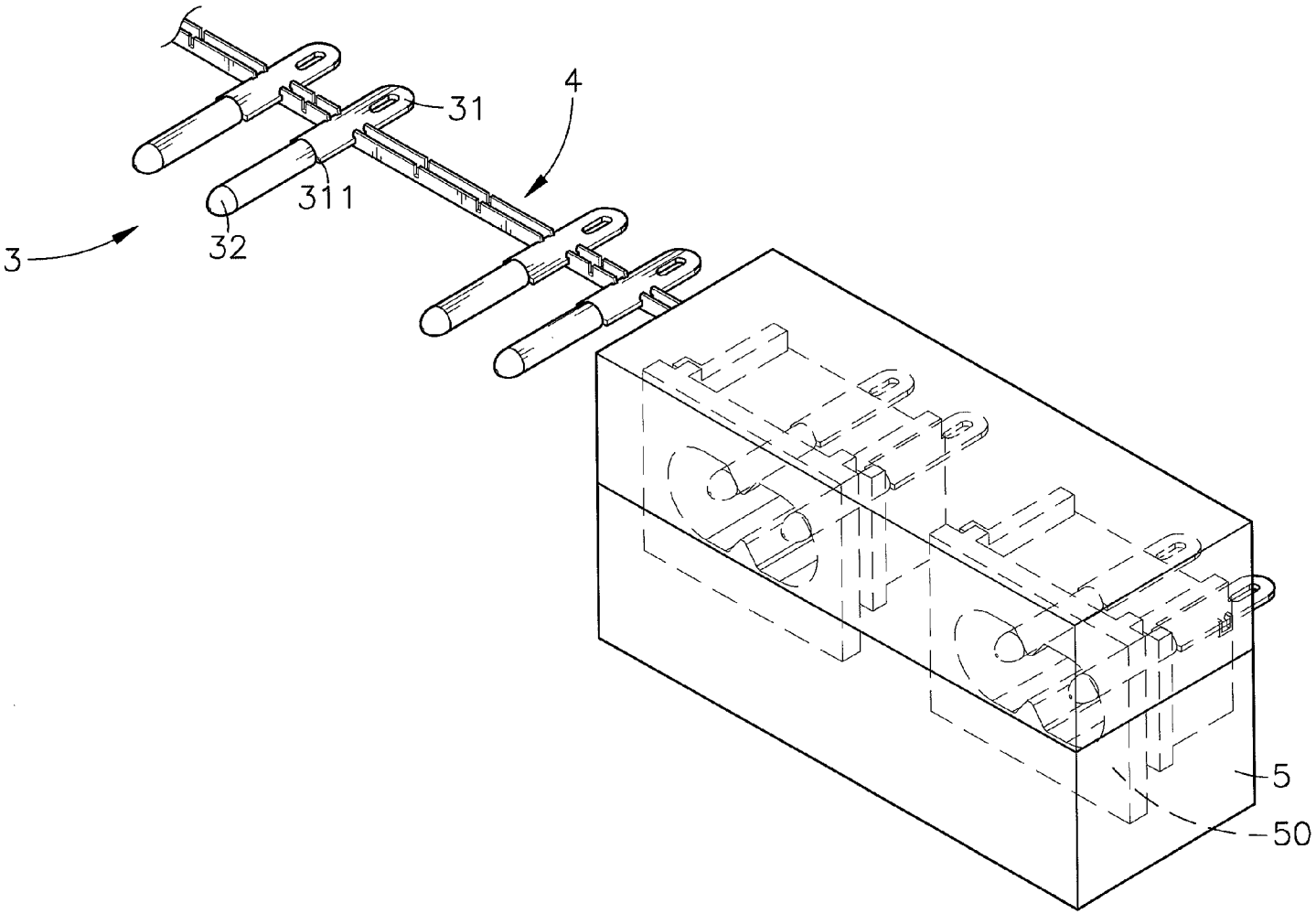
FIG. 4 is a schematic drawing illustrating the contact material strip moved toward a mold and metal contacts inserted into respective cavities of the mold during the application of the electrical power connector fabrication method in accordance with the first embodiment of the present invention.
Figure 5:
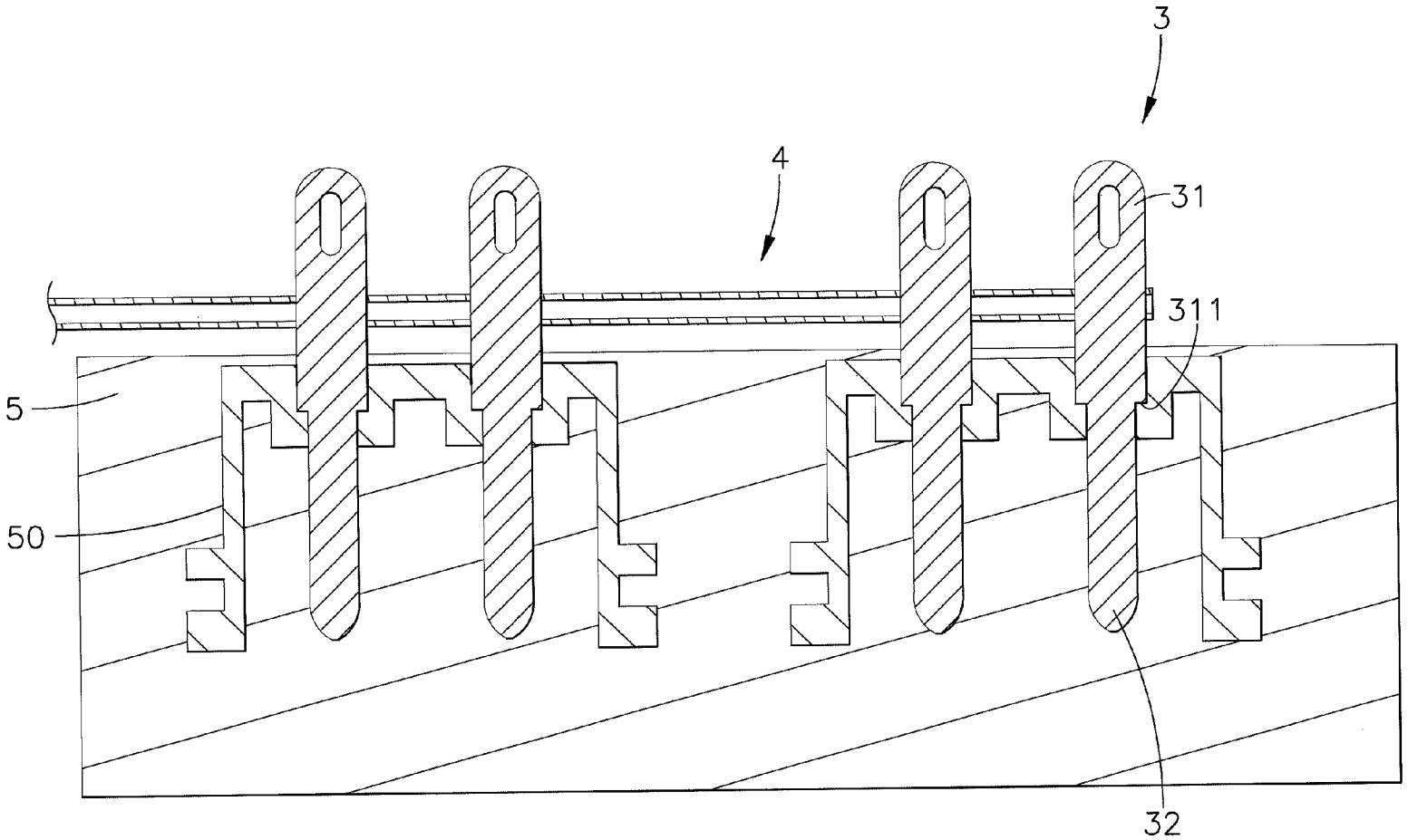
FIG. 5 is a sectional top view, in an enlarged scale, of a part of FIG. 4.
Figure 6:
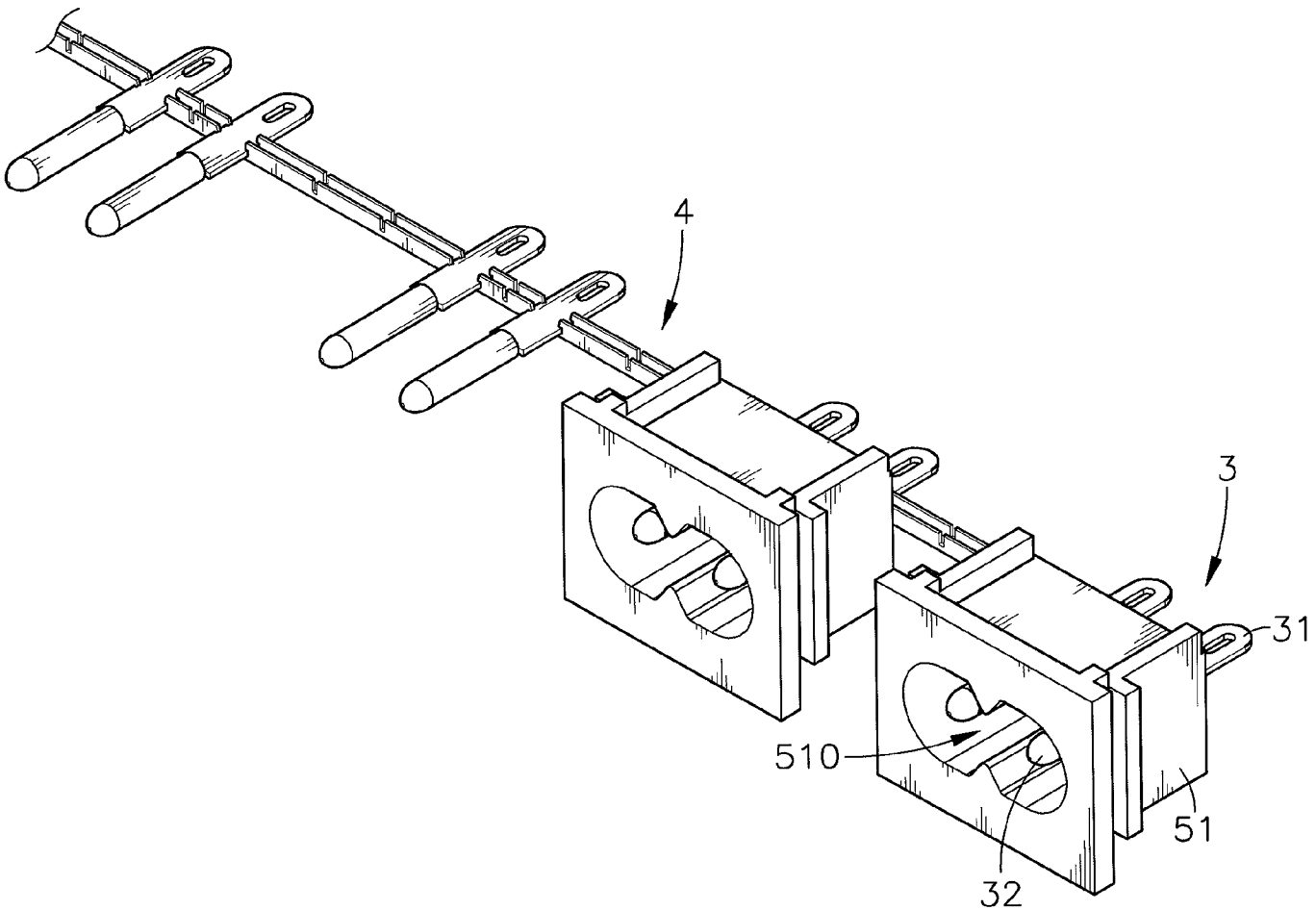
FIG. 6 is a schematic drawing illustrating the contact material strip moved toward two molds and metal contacts inserted into the respective cavities of the molds during the application of an alternate form of the electrical power connector fabrication method in accordance with the first embodiment of the present invention.
Figure 7:
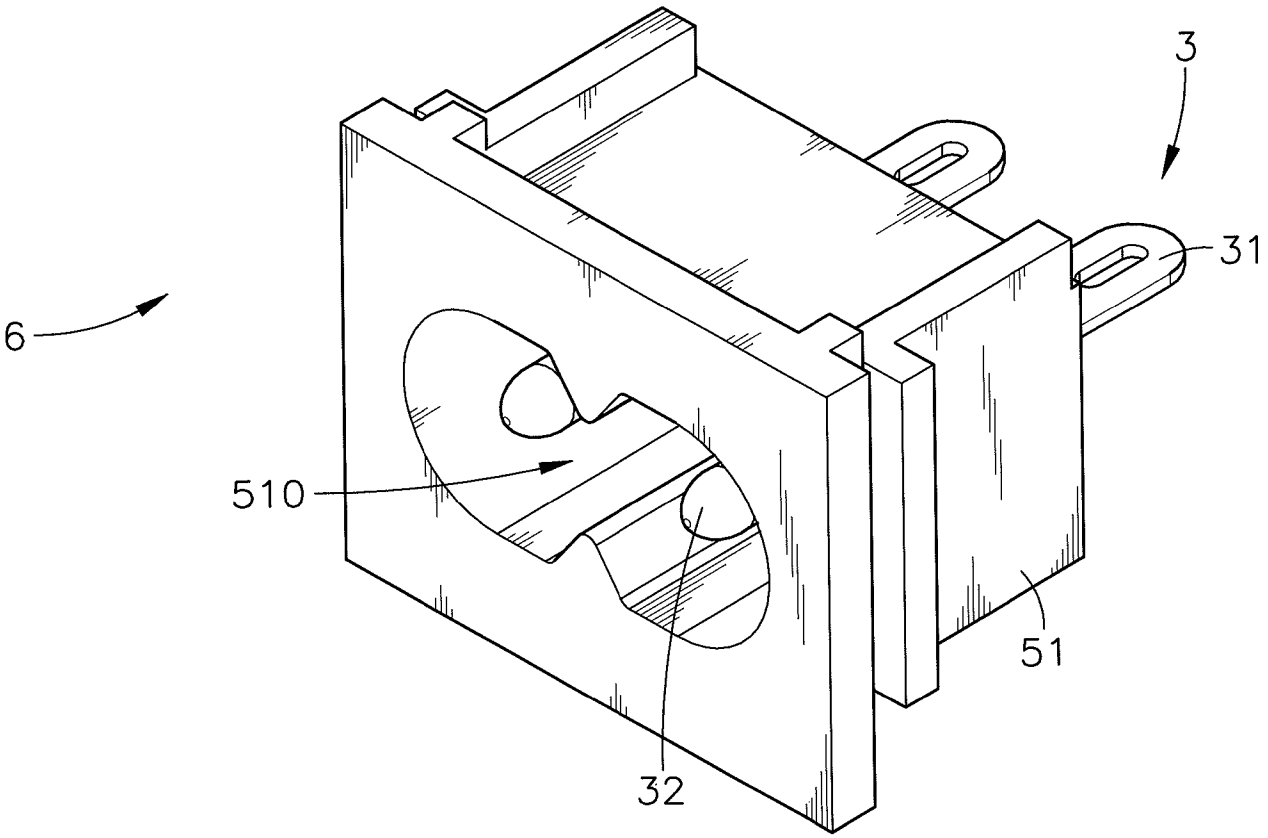
FIG. 7 is an elevational view of an electrical power connector made according to the first embodiment of the present invention.

Referring to FIGS. 1-7, a method for fabricating an electrical power connector in accordance with a first embodiment of the present invention is shown, comprising the steps of:

(100) employing a cold drawing technique with a series of dies 2 having different diameters of drawing holes 20 to repeatedly draw a metal round rod 1 into a thin thickness conducting contact bar 11;

(101) processing one end of the thin thickness conducting contact bar 11 into a mating contact portion 32;

(102) stamping a part of the thin thickness conducting contact bar 11 to form a mounting portion 31;

(103) attaching a part of the mounting portion 31 of the thin thickness conducting contact bar 11 to a locating notch 40 of a contact material strip 4 that has a U-shaped cross section with each locating notch located at the two parallel upright sidewalls of the U-shaped cross section, and then cutting off the thin thickness conducting contact bar 11 so that a finished metal contact 3 formed of the mounting portion 31 and the mating contact portion 32 is provided;

(104) attaching a plurality of metal contacts 3 in respective locating notches 40 of the contact material strip 4 in such a manner that each two metal contacts 3 are arranged in a set in a parallel manner and the multiple sets of finished metal contacts 3 are spaced from one another along the length of the contact material strip 4 at a predetermined interval;

(105) inserting the mating contact portions 32 of each set of metal contacts 3 at the contact material strip 4 and a part of the associating mounting portions 31 into one respective cavity 50 of one respective molding mold 5, and then injection-molding one respective electrically insulative housing 51 on each set of metal contacts 3 to form one respective electrical power connector 6; and (106) removing the contact material strip 4 from the metal contacts 3 of each electrical power connector 6.

Further, an electrical power connector 6 made subject to the electrical power connector fabrication method in accordance with the first embodiment of the present invention can be selectively designed in the form of a female (socket) type or male (plug) type. Further, the mounting portion 31 of each metal contact 3 has a flat shape configured for wire bond, wire clamp or DIP (dual inline package) application. Further, the metal round rod 1 can be a copper rod or copper alloy rod. Further, the mating contact portion 32 can have a conical shape. Further, when the thin thickness conducting contact bar 11 is stamped to form a mounting portion 31, a shoulder 311 is formed on the thin thickness conducting contact bar 11 between the mounting portion 31 and the associating mating contact portion 32. Further, the molding mold 5 used in the aforesaid electrical power connector preparation procedure can be designed to provide one or a number of cavities 50 so that one or a number of electrically insulative housings 51 can be molded on each respective set of metal contacts 3 by means of injection molding to form one or a number of electrical power connectors 6. By means of the contact material strip 4 to hold multiple sets of metal contacts 3 at a predetermined interval, multiple sets of metal contacts 3 can be simultaneously inserted into respective cavities 50 in the molding mold 5 positively and accurately so that multiple electrically insulative housings 51 can be simultaneously molded on respective sets of metal contacts 3 by means of injection molding to form multiple electrical power connectors 6 at a time. Subject to the aforesaid electrical power connector preparation procedure, the invention allows fabrication of electrical power connectors 6 manually, or using an automatic or semi-automatic equipment. Because multiple electrically insulative housings 51 can be simultaneously molded on respective sets of metal contacts 3 by means of injection molding to form multiple electrical power connectors 6 at a time, the invention greatly improves electrical power connector fabrication efficiency, shortens electrical power connector fabrication time, increases electrical power connector yield rate, and reduces electrical power connector manufacturing cost. Further, when female (socket) type electrical power connectors 6 are made, a mating space 510 is defined in the electrically insulative housing 51 of each female (socket) type electrical power connector 6 around the associating set of metal contacts 3 for receiving a mating male (plug) type electrical power connector. As the shoulders 311 of the metal contacts 3 are embedded in the electrically insulative housing 51 of the respective electrical power connector 6, the metal contact 3 are firmly positioned in the electrically insulative housing 51 of the respective electrical power connector 6, prolonging the lifespan of the electrical power connector 6.

By means of repeating steps (101)~(103), a large amount (50 pcs, 100 pcs, 150 pcs, 200 pcs or more) of metal contacts 3 can be prepared. After preparation of a large amount of metal contacts 3, steps (104)~(106) are performed, and thus a plurality of electrical power connectors 6 can be made.

Figure 8:
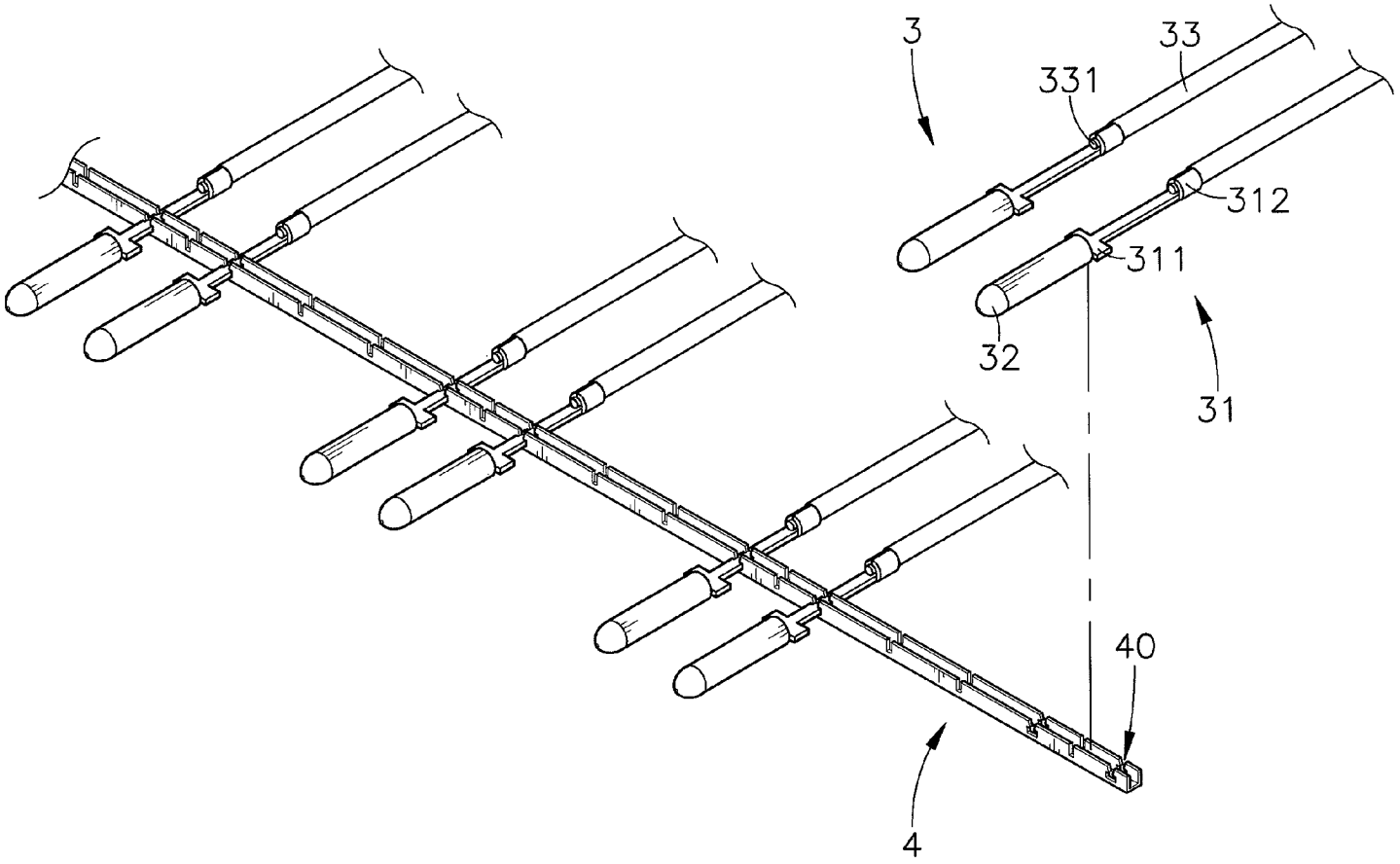
FIG. 8 is a schematic drawing illustrating multiple metal contacts made and connected with respective electrical wires for mounting at a contact material strip during application of an electrical power connector fabrication method in accordance with a second embodiment of the present invention.
Figure 9:
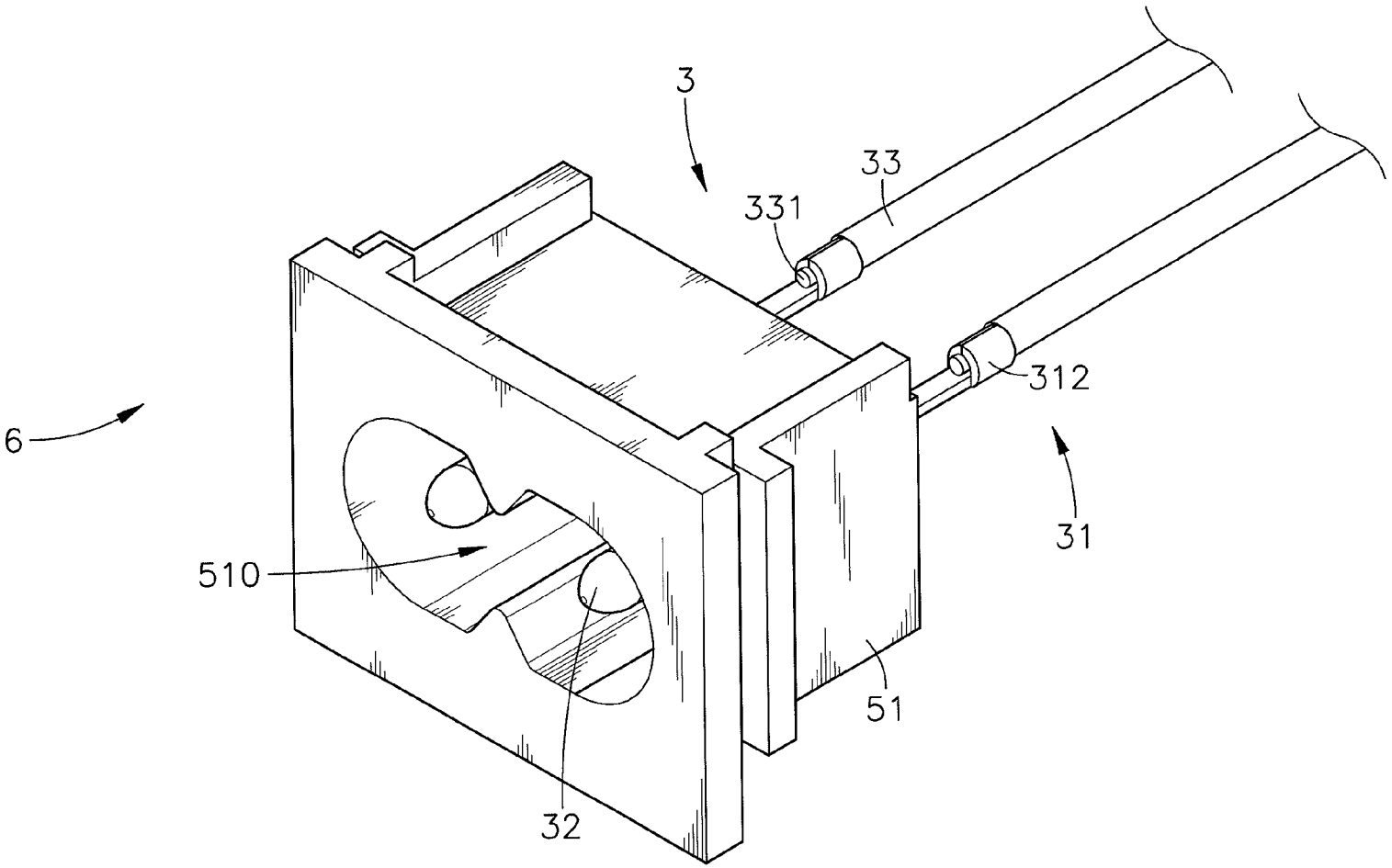
FIG. 9 is an oblique elevational view of an electrical power connector made subject to the electrical power connector fabrication method in accordance with the second embodiment of the present invention.
Figure 10:
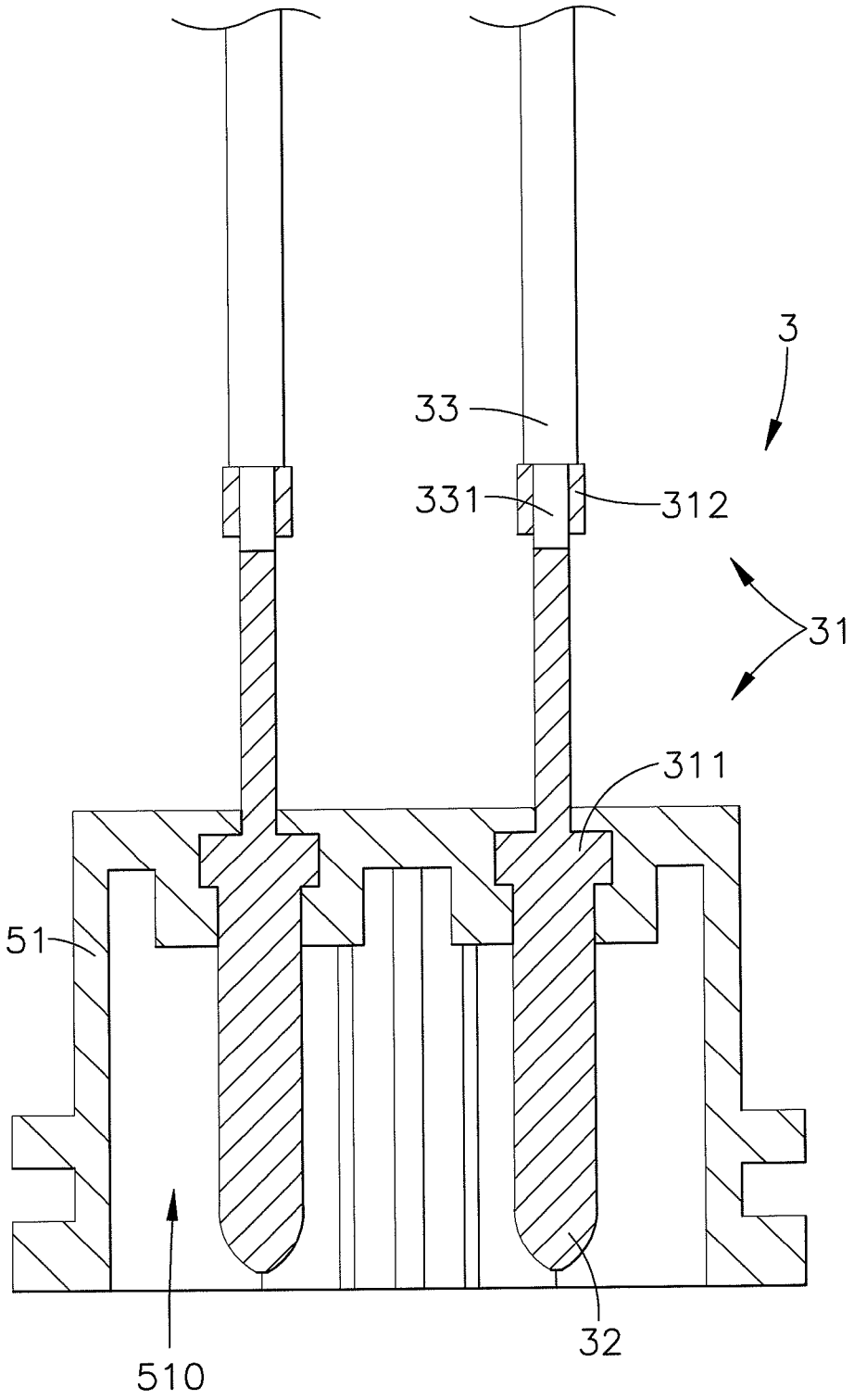
FIG. 10 is a sectional top view of the electrical power connector shown in FIG. 9.
Figure 11:
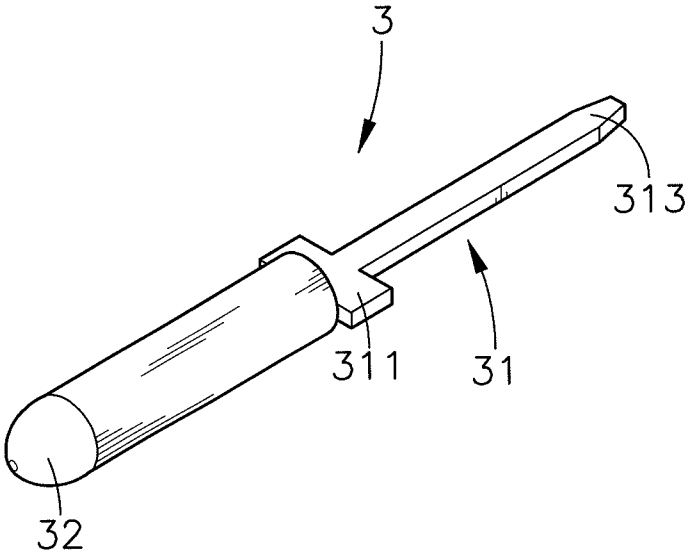
FIG. 11 is an oblique elevational view of an alternate form of metal contact constructed according to the present invention.
Figure 12:
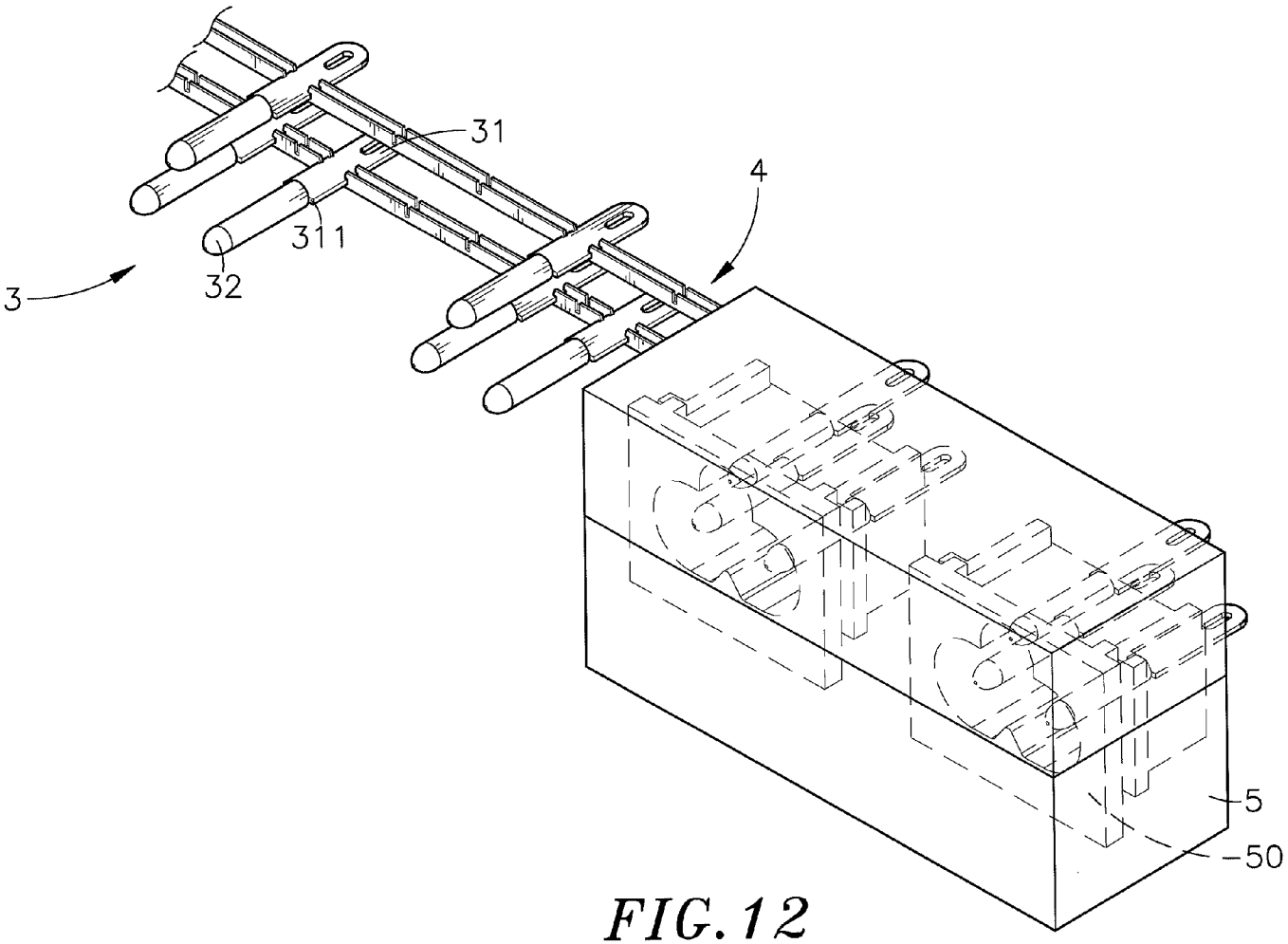
FIG. 12 is a schematic drawing illustrating two contact material strips disposed at different elevations and moved toward a mold and metal contacts inserted into respective cavities of the mold during the application of an electrical power connector fabrication method in accordance with a third embodiment of the present invention.
Figure 13:
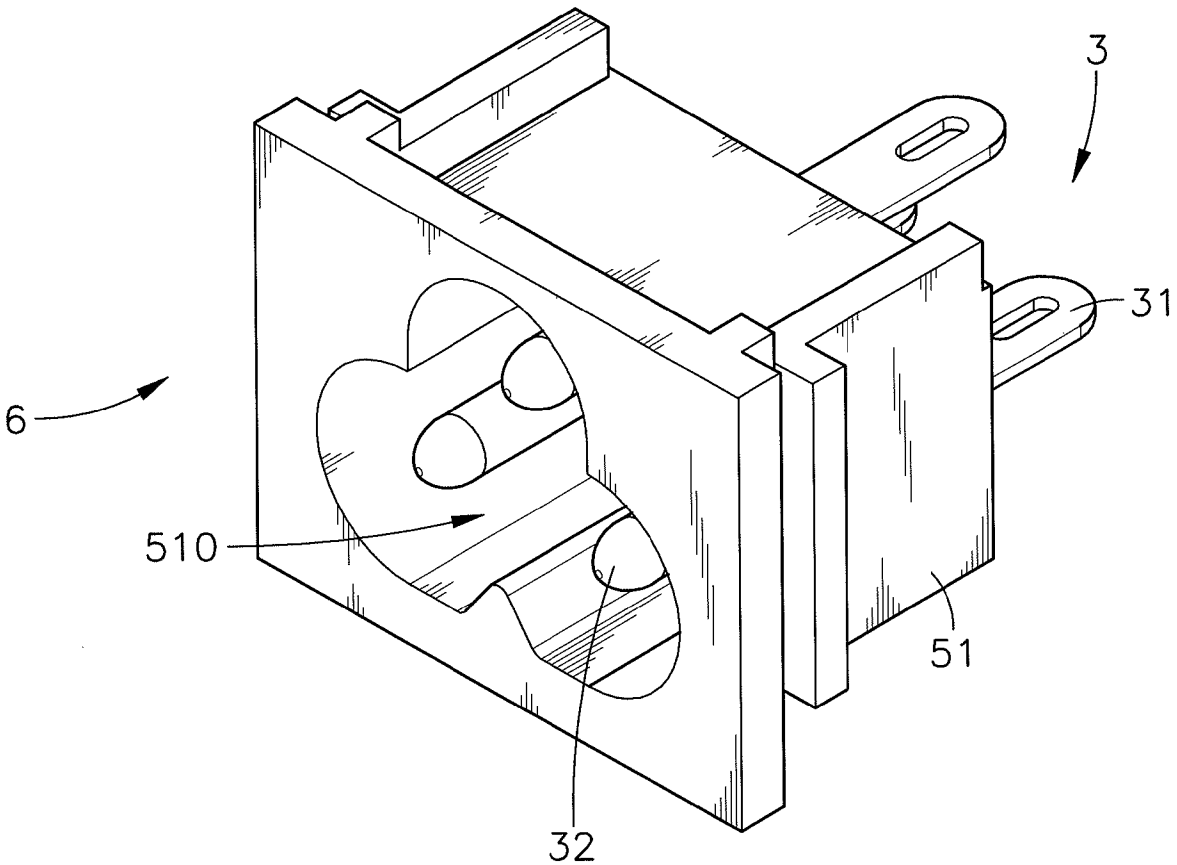
FIG. 13 is an oblique elevational view of an electrical power connector made subject to the electrical power connector fabrication method in accordance with the third embodiment of the present invention.
Figure 14:
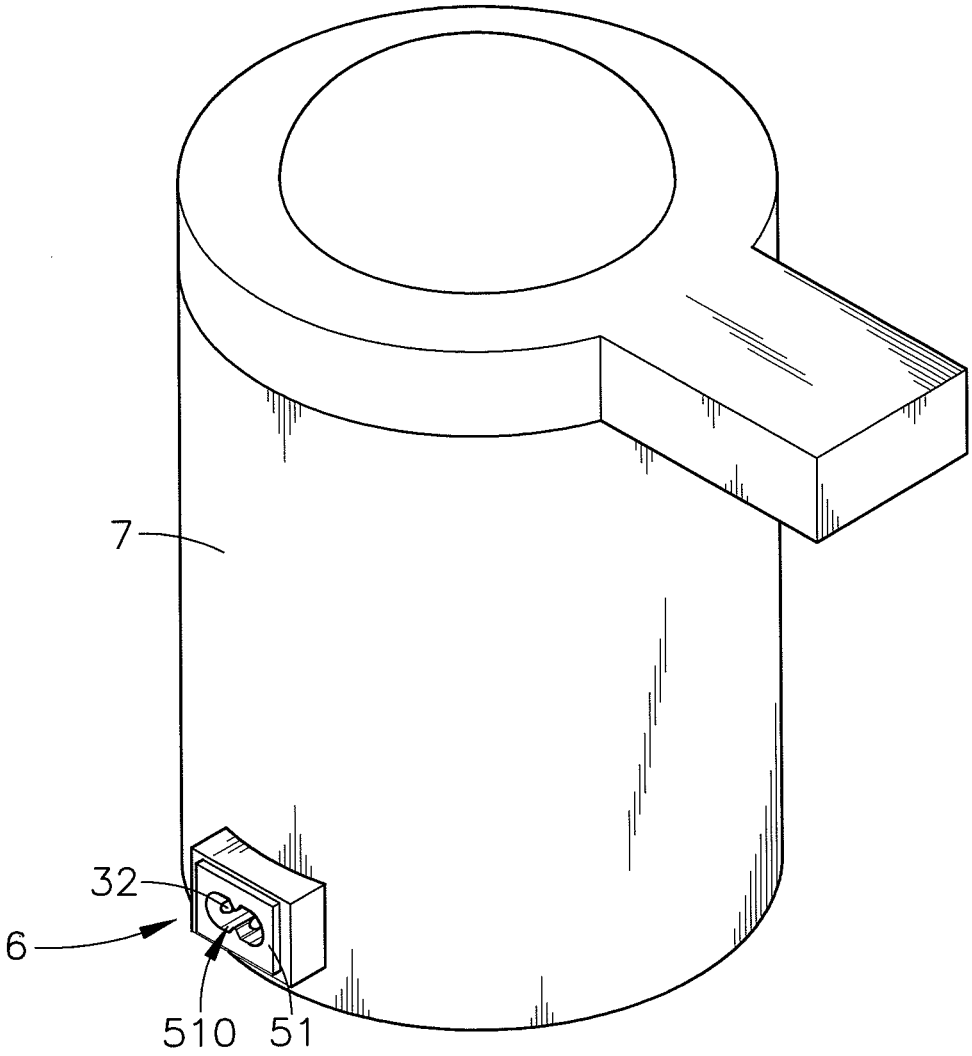
FIG. 14 is a schematic drawing illustrating an electrical power connector installed in an electrical home appliance according to the present invention.

Referring to FIGS. 8-10 and FIGS. 2-4 again, an electrical power connector fabrication method in accordance with a second embodiment of the present invention is substantially similar to the aforesaid first embodiment with the exception of the following features. After processed one end of the prepared thin thickness conducting contact bar 11 into a mating contact portion 32, stamp a part of the thin thickness conducting contact bar 11 to form a substantially I-shaped flat mounting portion 31 that has its front end forming a shoulder 311 and connected to the mating contact portion 32 and its other end cut off from the thin thickness conducting contact bar 11 to provide a clamping tailpiece 312. Thus, the mating contact portion 32 and the integrally connected I-shaped flat mounting portion 31 form a metal contact 3. Thereafter, repeat the aforesaid procedure to prepare a large amount of metal contacts 3, and then deform the clamping tailpiece 312 of the I-shaped flat mounting portion 31 of each metal contact 3 into a U shape to affix the clamping tailpiece 312 of the I-shaped flat mounting portion 31 of each metal contact 3 to a conductor 331 of one respective electrical wire 33, and then attach the I-shaped flat mounting portions 31 of metal contacts 3 with respective connected electrical wires 33 to respective locating notches 40 of a contact material strip 4 in such a manner that each two metal contacts 3 are arranged in a set in a parallel manner and the multiple sets of metal contacts 3 are spaced from one another along the length of the contact material strip 4 at a predetermined interval, and then insert the mating contact portions 32 of each set of metal contacts 3 at the contact material strip 4 and a part of the associating mounting portions 31 into one respective cavity 50 of one respective molding mold 5, and then mold one respective electrically insulative housing 51 on each set of metal contacts 3 to form one respective electrical power connector 6, and then remove the contact material strip 4 from the metal contacts 3.

Referring to FIGS. 11-14 and FIGS. 2-4 again, an electrical power connector fabrication method in accordance with a third embodiment of the present invention is substantially similar to the aforesaid first embodiment with the exception of the following features. After processed one end of the prepared thin thickness conducting contact bar 11 into a mating contact portion 32, stamp a part of the thin thickness conducting contact bar 11 to form a flat mounting portion 31 that can be in the form shown in FIGS. 2 and 3, or the form shown in FIG. 11 where the flat mounting portion 31 is substantially T-shaped, having its front end forming a shoulder 311 and connected to the mating contact portion 32 and its other end cut off from the thin thickness conducting contact bar 11 to provide a plug tip 313. After preparation of a large amount of metal contacts 3, attach metal contacts 3 to respective locating notches 40 of a plurality of contact material strips 4 in such a manner that each two metal contacts 3 are arranged in a set in a parallel manner and the multiple sets of metal contacts 3 are spaced from one another along the length of each respective contact material strip 4 at a predetermined interval, and then hold two contact material strips 4 with the respective metal contacts 3 at different elevations, and then insert the mating contact portions 32 of each set of metal contacts 3 at each of the two contact material strips 4 into one respective cavity 50 of one respective molding mold 5, and then mold one respective electrically insulative housing 51 on the respective metal contacts 3 to form one respective DIP type electrical power connector 6, and then remove the contact material strips 4 from the metal contacts 3. Alternatively, after preparation of a large amount of metal contacts 3, attach metal contacts 3 to respective locating notches 40 of one first contact material strip 4 in such a manner that the metal contacts 3 are spaced from one another along the length of the first contact material strip 4 at a predetermined first interval and attach metal contacts 3 respective locating notches 40 of a second contact material strips 4 in such a manner that each two metal contacts 3 are arranged in a set in a parallel manner and the multiple sets of metal contacts 3 at the second contact material strip 4 are spaced from one another along the length of the second contact material strip 4 at a predetermined second interval, and then hold the first and second contact material strips 4 with the respective metal contacts 3 at different elevations to suspend each metal contact 3 at the first contact material strip 4 above one respective set of metal contacts 3 at the second contact material strip, and then insert the mating contact portions 32 of each metal contact 3 at the first contact material strip 4 and the mating contact portions 32 of the corresponding set of metal contacts 3 at the second contact material strip 4 into one respective cavity 50 of one respective molding mold 5, and then mold one respective electrically insulative housing 51 on each metal contact 3 at the first contact material strip 4 and the respective set of metal contacts 3 at the second contact material strip 4 to form 3-pin electrical power connector 6, and then remove the contact material strips 4 from the metal contacts 3.

An electrical power connector 6 in accordance with this third embodiment of the present invention can be installed in an electrical home appliance 7 for power input.

Figure 15:
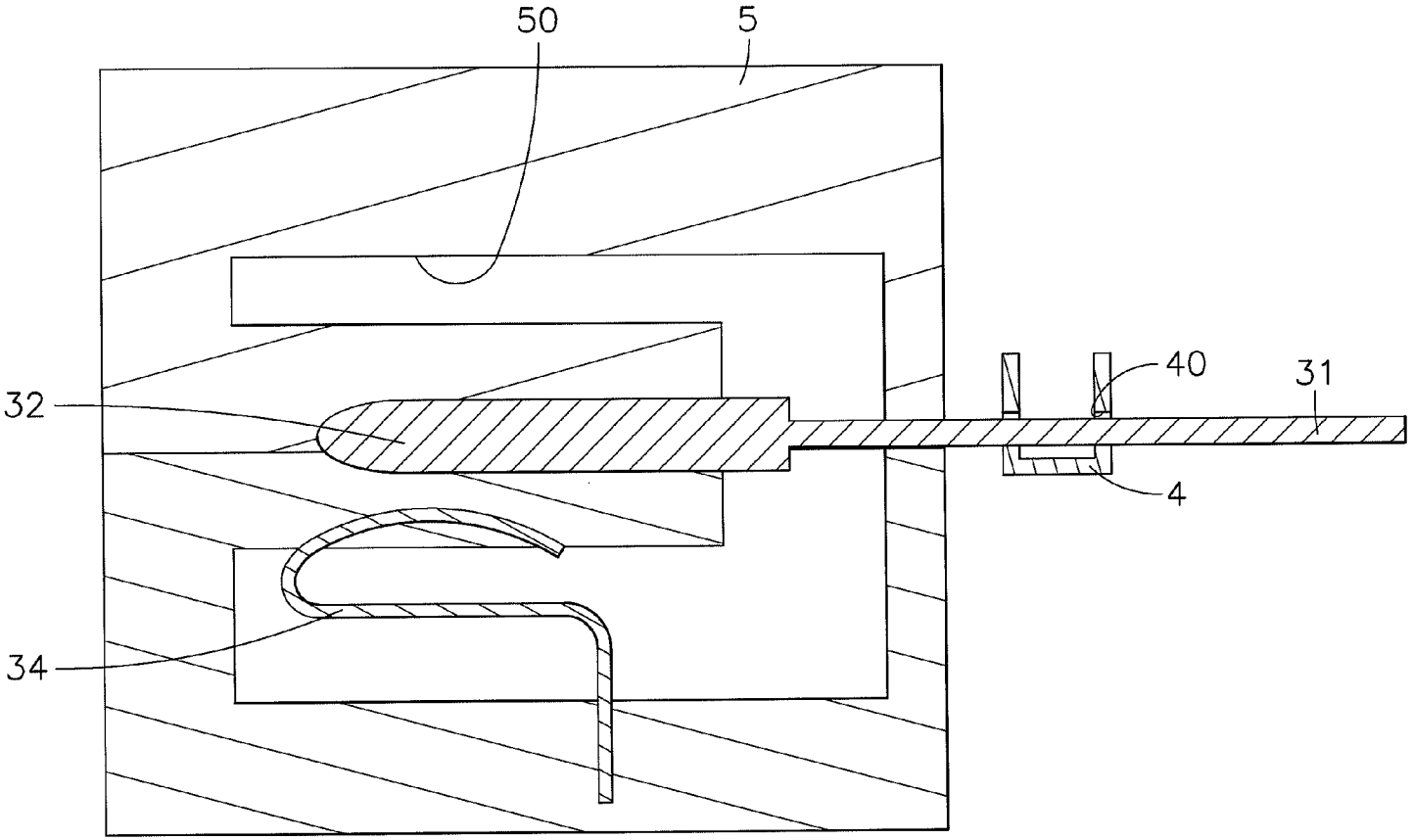
FIG. 15 is a schematic sectional view illustrating a metal contact and a grounding contact inserted into a cavity of a mold during the application of an electrical power connector fabrication method in accordance with a fourth embodiment of the present invention.
Figure 16:
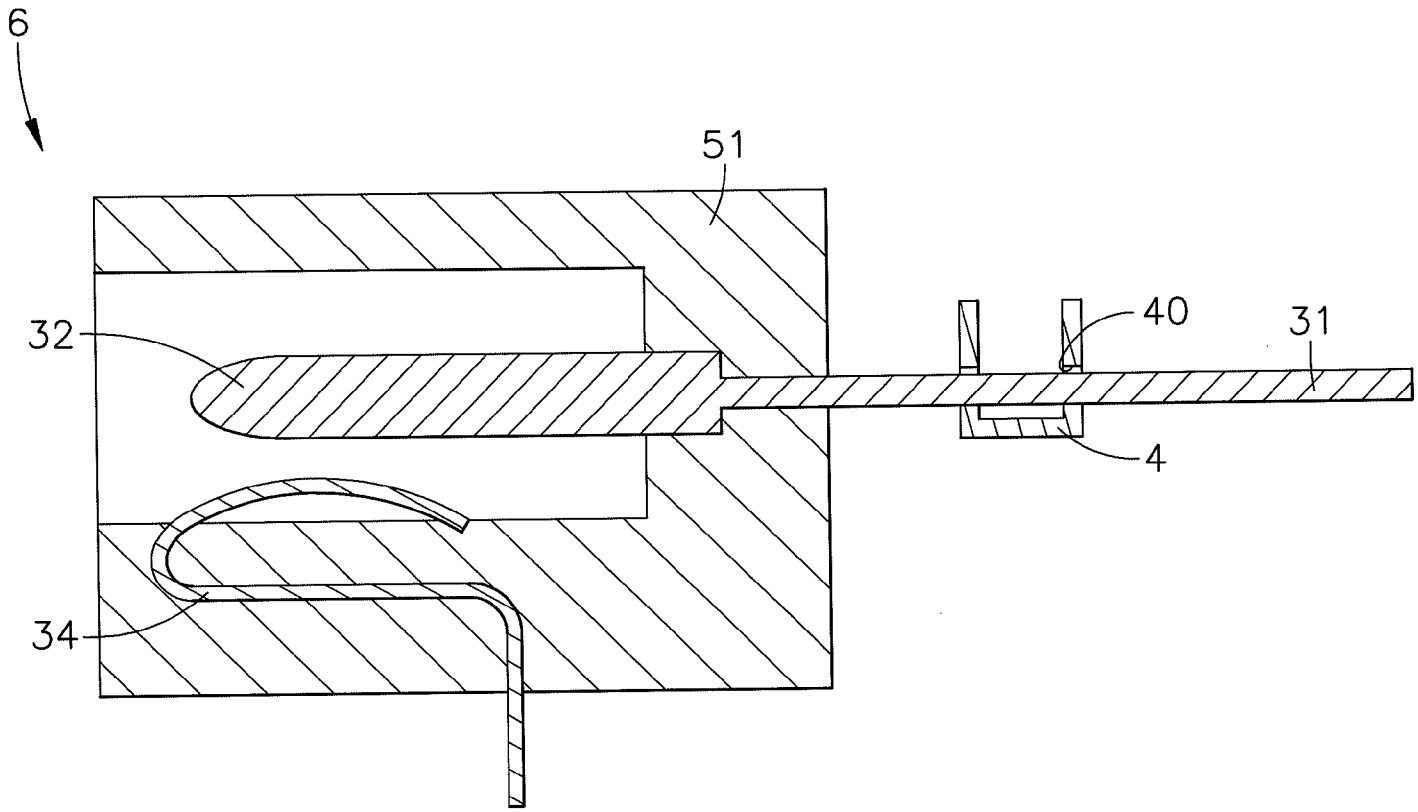
FIG. 16 is a sectional view of an electrical power connector made subject to the electrical power connector fabrication method in accordance with the fourth embodiment of the present invention before removal of the contact material strip.
Figure 17:
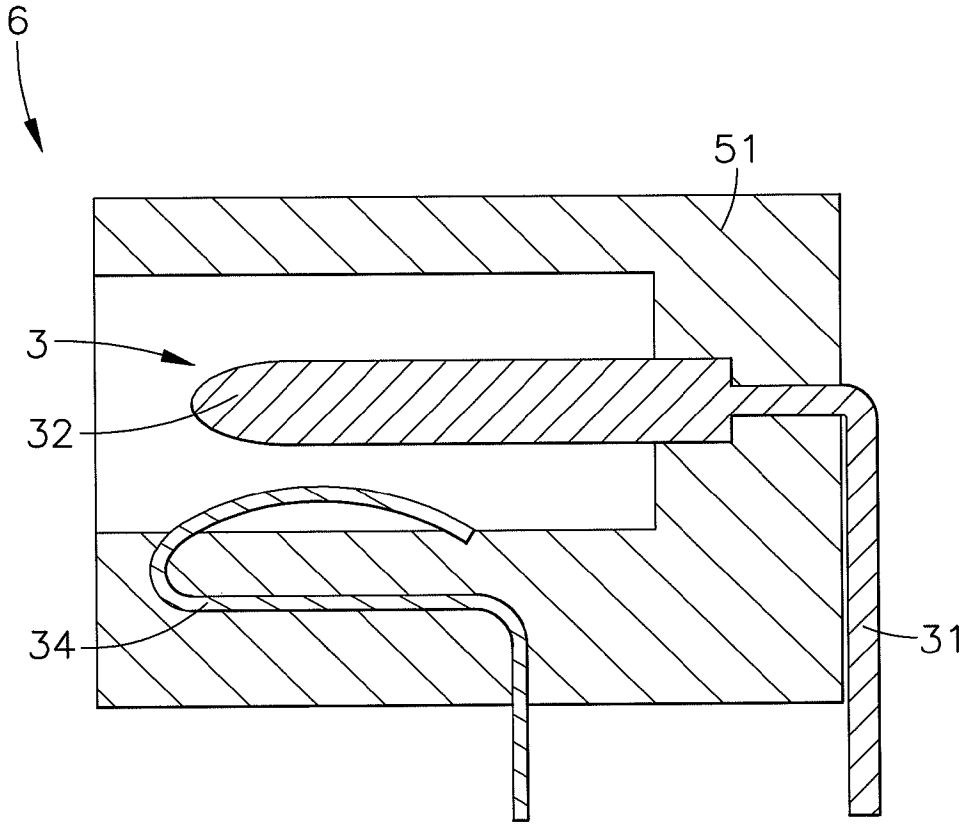
FIG. 17 corresponds to FIG. 16, illustrating the mounting portions of the metal contact curved vertically downward after removal of the contact material strip.
Figure 18:
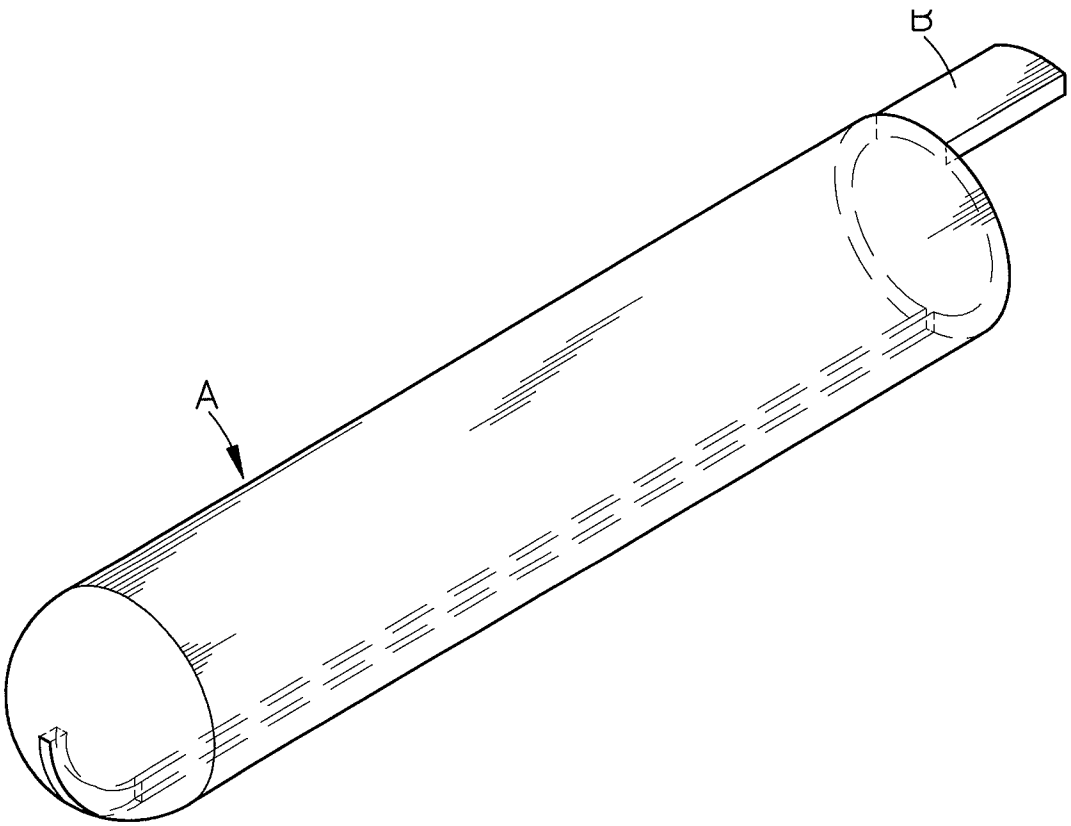
PRIOR ART FIG. 18
FIG. 18 is an oblique elevation of a metal contact for electrical power connector according to the prior art.
Figure 19:
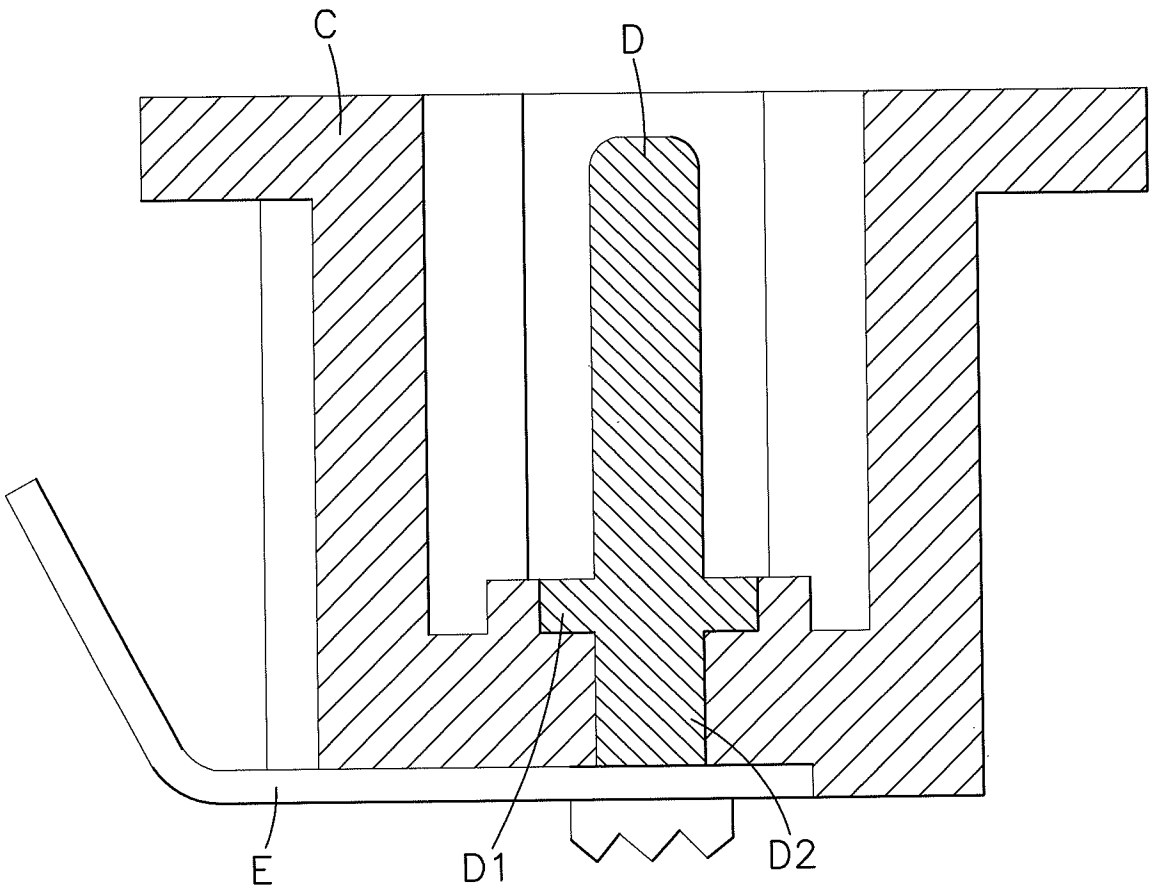
PRIOR ART FIG. 19
FIG. 19 is a sectional side view of an electrical power connector according to the prior art.

Referring to FIGS. 15-17 and FIGS. 2-3 again, an electrical power connector fabrication method in accordance with a fourth embodiment of the present invention is substantially similar to the aforesaid first embodiment with the exception of the following features.

After preparation of a large amount of metal contacts 3, attach individual metal contacts 3 to equally spaced locating notches 40 of two contact material strips 4, and then move the two contact material strips 4 toward molding molds 5 from back and bottom sides to insert the mating contact portion 32 of one respective metal contact 3 at each of the two contact material strips 4 into one respective cavity 50 of a molding mold 5 where the metal contact 3 that is inserted into each cavity 50 from the bottom side works as a grounding contact 34, and then mold one respective electrically insulative housing 51 in each cavity 50 on the respective two metal contacts 3 to form one respective electrical power connector 6, and then remove the contact material strips 4 from the metal contacts 3. Then, the mounting portions 31 are bent vertically downwards and abut the outer wall of the back side of the molding mold 5.

As stated above, the invention provides an electrical power connector fabrication method for making electrical power connectors by: employing a cold drawing technique with the use of a series of dies 2 having different diameters of drawing holes 20 to repeatedly draw a metal round rod 1 into a thin thickness conducting contact bar 11, and then processing one end of the thin thickness conducting contact bar 11 into a mating contact portion 32, and then stamping a part of the thin thickness conducting contact 11 to form a mounting portion 31, and then cutting off the thin thickness conducting contact bar 11 so that a finished metal contact 3 formed of the mounting portion 31 and the mating contact portion 32 is obtained, and then repeating the aforesaid steps to obtain a large amount of metal contacts 3, and then attaching individual metal contacts 3 to respective locating notches 40 of a contact material strip 4, and then using an injection molding technique to mold electrically insulative housings 51 on the metal contacts 3 to form a number of electrical power connectors 6 at a time, and removing the contact material strip 4 from the metal contacts 3. Alternatively, each individual metal contact 3 can be positioned in one respective locating notch 40 of the contact material strip 4 during the stamping step to make the mounting portion 31.

As stated above, the invention provides an electrical power connector fabrication method for making electrical power connectors, which has the advantages and features as follows:

1. The invention can obtain a large amount of metal contacts 3 rapidly and economically without producing much waste material by: employing a cold drawing technique with a series of dies 2 having different diameters of drawing holes 20 to repeatedly draw a metal round rod 1 into a thin thickness conducting contact bar 11, and then processing one end of the thin thickness conducting contact bar 11 into a mating contact portion 32 and stamping a part of the thin thickness conducting contact 11 to form a mounting portion 31, and then cutting off the thin thickness conducting contact bar 11, and then repeating the aforesaid steps.
2. When a metal contact 3 is prepared, a shoulder 311 is formed between the mounting portion 31 and the mating contact portion 3. After molding of an electrically insulative housing 51 on metal contacts 3 to form an electrical power connector 6, the shoulders 311 of the metal contacts 3 are embedded in the electrically insulative housing 51 of the electrical power connector 6, and therefore the metal contact 3 are firmly positioned in the electrically insulative housing 51 of the electrical power connector 6, prolonging the lifespan of the electrical power connector 6.
3. By means of using contact material strips 4 to hold a large amount of metal contacts 3, an automatic equipment or manual equipment can be used and operated to move contact material strips 4, moving carried metal contacts 3 into cavities 50 of molds 5 for injection molding, facilitating mass production of electrical power connectors.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical power connector fabrication method, comprising the steps of:

(a) employing a cold drawing technique to draw a metal round rod into a thin thickness conducting contact bar;

(b) processing one end of said thin thickness conducting contact bar into a mating contact portion;

(c) stamping a part of said thin thickness conducting contact to form a mounting portion;

(d) attaching a part of said mounting portion of said thin thickness conducting contact to one of a plurality of locating notches of one contact material strip and then cutting off said thin thickness conducting contacts so that a finished metal contact formed of said mounting portion and said mating contact portion is provided;

(e) attaching a plurality of metal contacts in respective locating notches of at least one said contact material strip;

(f) inserting at least two mating contact portions of said metal contacts at at least one said contact material strip into at least one cavity of at least one molding mold, and then employing an injection-molding technique to mold an electrically insulative housing in each said cavity of each said molding mold on at least one said metal contact to form an electrical power connector in each said cavity of each said molding mold; and (g) removing the metal contacts and said electrically insulative housing of each said electrical power connector respectively from at least one said contact material strip and said molding mold.

2. The electrical connector fabrication method as claimed in claim 1, wherein said metal round rod is selected from the material group of copper and copper alloys.

3. The electrical connector fabrication method as claimed in claim 1, wherein said mounting portion made during step (c) is configured for one of wire bond, wire clamp and DIP (dual inline package) applications.

4. The electrical connector fabrication method as claimed in claim 1, wherein said mating contact portion has a conical shape.

5. The electrical connector fabrication method as claimed in claim 1, wherein steps (b)~(d) is repeated in step (e) to provide a plurality of metal contacts in one of the amount of 50 pcs, 100 pcs, 150 pcs and 200 pcs, and steps (e)~(g) are performed after preparation of the desired amount of metal contacts at step (e).

6. The electrical connector fabrication method as claimed in claim 1, further comprising a sub step of electrically connecting one respective electrical wire to the mounting portion of each said metal contact after step (e) and before step (f).

7. The electrical connector fabrication method as claimed in claim 1, wherein a shoulder is formed on said thin thickness conducting contact between said contact portion and said mounting portion when stamping a part of said thin thickness conducting contact to form said mounting portion during step (c).

8. The electrical connector fabrication method as claimed in claim 1, wherein said contact material strip used during step (d) has a U-shaped cross section, and each said locating notch of said contact material strip is located at two parallel upright sidewalls of said U-shaped cross section.

9. The electrical connector fabrication method as claimed in claim 1, wherein during step (f) to insert the mating contact portions of said metal contacts at at least one said contact material strip into at least one cavity of at least one molding mold is to hold a plurality of said contact material strips at different elevations and then to move said contact material strips toward at least one said molding mold for enabling the contact portions of each three said metal contacts to be inserted in a triangular pattern in one said cavity of one said molding mold for making a 3-pin electrical power connector.

10. The electrical connector fabrication method as claimed in claim 1, wherein during step (f) to insert the mating contact portions of said metal contacts at at least one said contact material strip into at least one cavity of at least one molding mold is to move one said contact material strip toward at least one said molding mold for enabling the contact portions of each two adjacent said metal contacts to be inserted in a parallel manner in one respective said cavity of each said molding mold and said mounting portion extended out of said electrically insulative housing for making a 2-pin electrical power connector.

11. The electrical connector fabrication method as claimed in claim 1, wherein said mounting portion made during step (c) is a substantially I-shaped flat mounting portion, having one end thereof forming a shoulder and connected to said mating contact portion and an opposite end thereof cut off from said thin thickness conducting contact bar to form a clamping tailpiece.

12. The electrical connector fabrication method as claimed in claim 1, wherein said mounting portion made during step (c) is a substantially T-shaped flat mounting portion, having one end thereof forming a shoulder and connected to said mating contact portion and an opposite end thereof cut off from said thin thickness conducting contact bar to form a plug tip.

13. The electrical connector fabrication method as claimed in claim 1, wherein during step (f) to insert the mating contact portion of said metal contacts at at least one said contact material strip into at least one cavity of at least one molding mold is to move two contact material strips toward each said molding mold horizontally from back and bottom sides to insert the mating contact portion of one respective said metal contact at each of the two contact material strips into each cavity of each molding mold and then to mold one respective electrically insulative housing in each said cavity on the respective two said metal contacts to form one respective electrical power connector so that the metal contact that is inserted into each cavity from the bottom side works as a grounding contact.

* * * * *